US010042317B2

(12) United States Patent
Boettcher et al.

(10) Patent No.: US 10,042,317 B2
(45) Date of Patent: Aug. 7, 2018

(54) PHOTOCONDUCTOR LUBRICANT ASSEMBLY

(71) Applicant: LEXMARK INTERNATIONAL, INC., Lexington, KY (US)

(72) Inventors: Brian Lester Boettcher, Versailles, KY (US); Joshua Carl Poterjoy, Bainbridge, PA (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/347,018

(22) Filed: Nov. 9, 2016

(65) Prior Publication Data

US 2017/0205760 A1 Jul. 20, 2017

Related U.S. Application Data

(60) Provisional application No. 62/278,591, filed on Jan. 14, 2016.

(51) Int. Cl.
*G03G 21/00* (2006.01)

(52) U.S. Cl.
CPC ..... *G03G 21/0094* (2013.01)

(58) Field of Classification Search
CPC ..... G03G 21/0094
IPC ..... G03G 21/0094
See application file for complete search history.

(56) References Cited

U.S. PATENT DOCUMENTS 6,295,438 B1 * 9/2001 Fujishiro ..... G03G 15/0105 399/299

* cited by examiner

*Primary Examiner* — Hoang Ngo
(74) *Attorney, Agent, or Firm* — Justin M. Tromp

(57) ABSTRACT

A photoconductor unit for an electrophotographic image forming device according to one example embodiment includes a housing and a photoconductive drum rotatably mounted on the housing. The photoconductive drum has an outer surface. A cap is detachably mounted on the housing. A lubricant supply is positioned to provide a lubricant material to the outer surface of the photoconductive drum. The lubricant supply is mounted on the cap such that detachment of the cap from the housing separates the lubricant supply from the housing permitting replacement of the lubricant supply independent of the photoconductive drum.

9 Claims, 7 Drawing Sheets

PHOTOCONDUCTOR LUBRICANT ASSEMBLY

CROSS REFERENCES TO RELATED APPLICATIONS

This application claims priority to U.S. Provisional Patent Application Ser. No. 62/278,591, filed Jan. 14, 2016, entitled "Photoconductor Lubricant Assembly," the content of which is hereby incorporated by reference in its entirety.

BACKGROUND

1. Field of the Disclosure

The present disclosure relates generally to image forming devices and more particularly to a photoconductor lubricant assembly.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the photoconductive drum. The toned image is transferred to the print media (e.g., paper) either directly by the photoconductive drum in a one-step transfer system or indirectly by an intermediate transfer member in a two-step transfer system.

Manufacturers continually seek to extend the useful life of the photoconductive drum. One approach is to apply a lubricant, such as zinc stearate, to the surface of the photoconductive drum during operation. For example, a rotatable applicator brush may scrape lubricant from a block and apply the lubricant to the surface of the photoconductive drum. An improved assembly to supply lubricant to the photoconductive drum is desired.

SUMMARY

A photoconductor unit for an electrophotographic image forming device according to one example embodiment includes a housing and a photoconductive drum rotatably mounted on the housing. The photoconductive drum has an outer surface. A cap is detachably mounted on the housing. A lubricant supply is positioned to provide a lubricant material to the outer surface of the photoconductive drum. The lubricant supply is mounted on the cap such that detachment of the cap from the housing separates the lubricant supply from the housing permitting replacement of the lubricant supply independent of the photoconductive drum.

A photoconductor lubricant assembly according to one example embodiment includes a cap that is detachably mountable onto a housing of a photoconductor unit. A lubricant supply is mounted on the cap for providing a lubricant material to a photoconductive drum of the photoconductor unit. The lubricant supply includes a block composed of the lubricant material. A retention tab on the cap retains the lubricant supply on the cap. The retention tab is deflectable providing a snap-fit engagement of the lubricant supply onto the cap. A biasing member biases the lubricant supply against the retention tab.

A photoconductor unit for an electrophotographic image forming device according to another example embodiment includes a housing and a photoconductive drum rotatably mounted on the housing. The photoconductive drum has an outer surface. A lubricant applicator brush is rotatably mounted on the housing and in contact with the outer surface of the photoconductive drum along a length of the outer surface of the photoconductive drum. A cap is detachably mounted on the housing. A lubricant supply is mounted on the cap. The lubricant supply includes a block composed of a lubricant material. A retainer on the cap retains the lubricant supply on the cap when the cap is detached from the housing. A biasing member biases the block composed of the lubricant material against the lubricant applicator brush.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
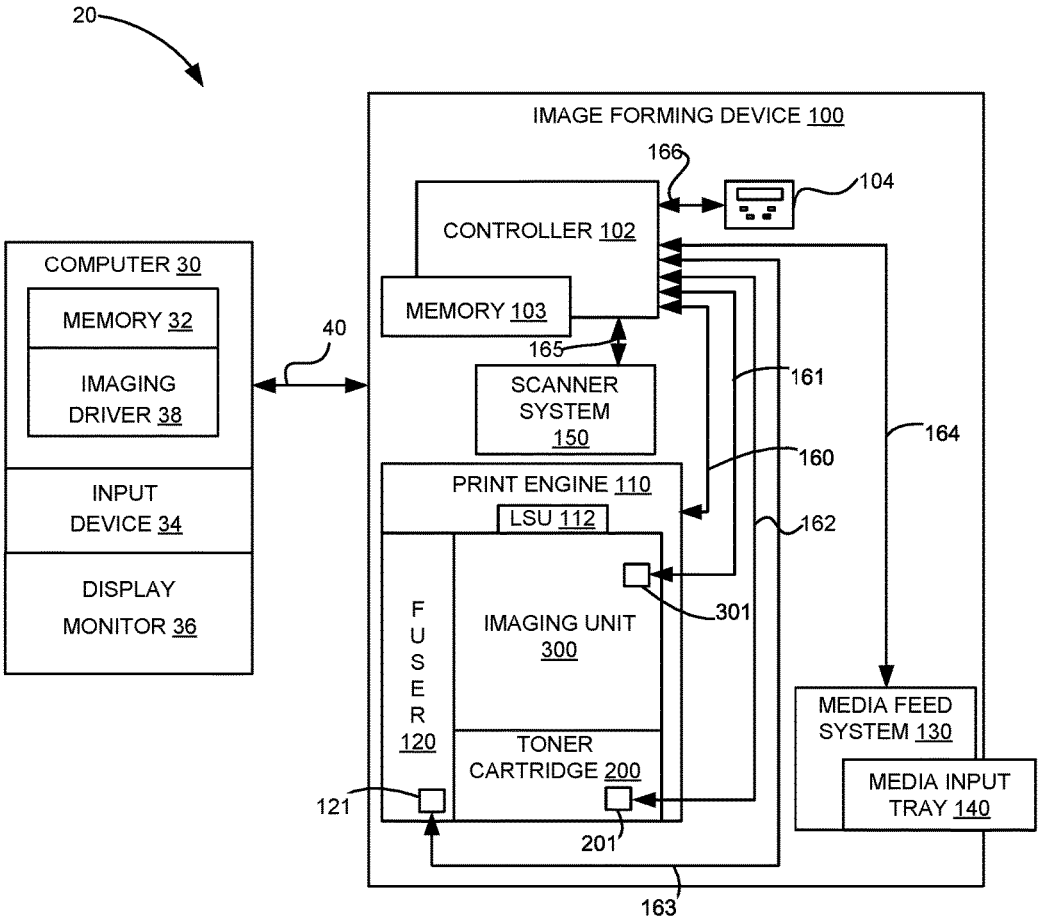
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
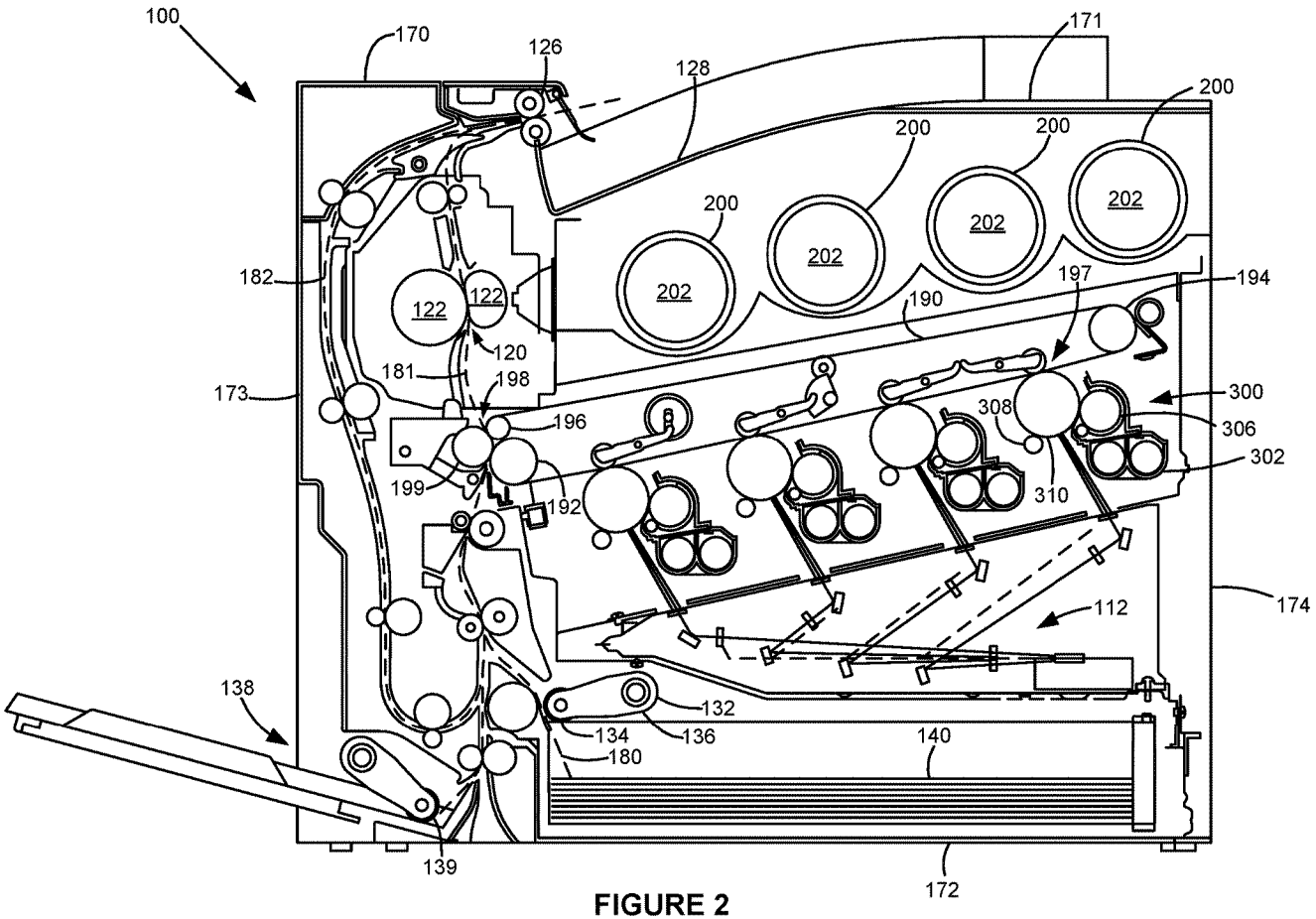
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173, rear 174 and a pair of sides (one facing out of the page and one facing into the page as viewed in FIG. 2). Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which are also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 contain yellow, cyan, magenta and black toner, respectively.

In the example embodiment illustrated, image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Magnetic roll 306 includes a stationary core that includes one or more permanent magnets and a rotatable sleeve that encircles the core. Reservoir 302 may include toner agitators, such as paddles, augers, etc., that stir the developer mix and present the developer mix to magnetic roll 306. Each imaging unit 300 also includes a charge roll 308, a photoconductive drum (PC drum) 310 and a cleaner blade or roll (not shown) that collectively form a photoconductor unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. The permanent magnet(s) of magnetic roll 306 attract the carrier beads in reservoir 302 having toner thereon to the outer surface of the sleeve of magnetic roll 306. The sleeve of magnetic roll 306 transports the carrier beads having toner thereon past a trim bar that trims the mix of carrier beads and toner to a predetermined average height on the outer surface of the sleeve. The sleeve of magnetic roll 306 then transports the carrier beads having toner thereon to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a respective first transfer nip 197. In one embodiment, a positive voltage field attracts the toner images from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a multicolor image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art.

While the example image forming device 100 shown in FIG. 2 utilizes a dual component development system, in another embodiment, image forming device 100 utilizes what is commonly referred to as a single component development system. In this embodiment, a toner adder roll in each developer unit has an outer surface that is in contact with and forms a nip with the outer surface of a corresponding developer roll. As the toner adder roll and the developer roll rotate, the toner adder roll supplies toner in reservoir 302 to the developer roll. The developer roll is electrically charged and electrostatically attracts the toner particles supplied by the toner adder roll. A doctor blade positioned along each developer roll provides a substantially uniform layer of toner on the developer roll. The outer surface of the developer roll is also in contact with and forms a nip with the outer surface of a corresponding PC drum 310. As the developer roll and PC drum 310 rotate, toner particles are electrostatically transferred from the developer roll to the latent image on PC drum 310 forming a toned image on the surface of PC drum 310. PC drum 310 is charged by charge roll 308 and cleaned by a cleaner blade/roll as discussed above.

Figure 3:
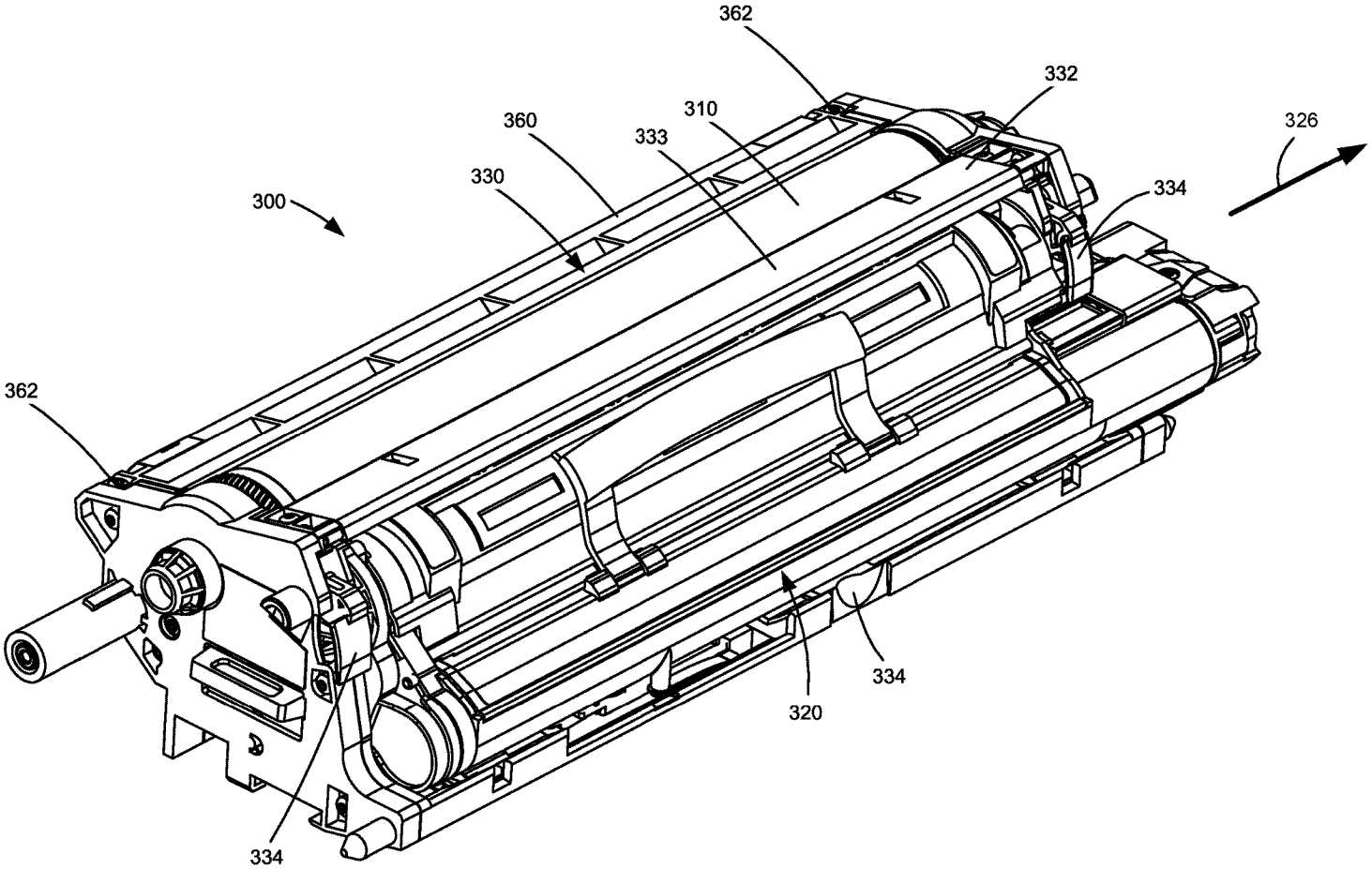
FIG. 3 is a perspective view of an imaging unit including a developer unit and a photoconductor unit according to one example embodiment.
Figure 4:
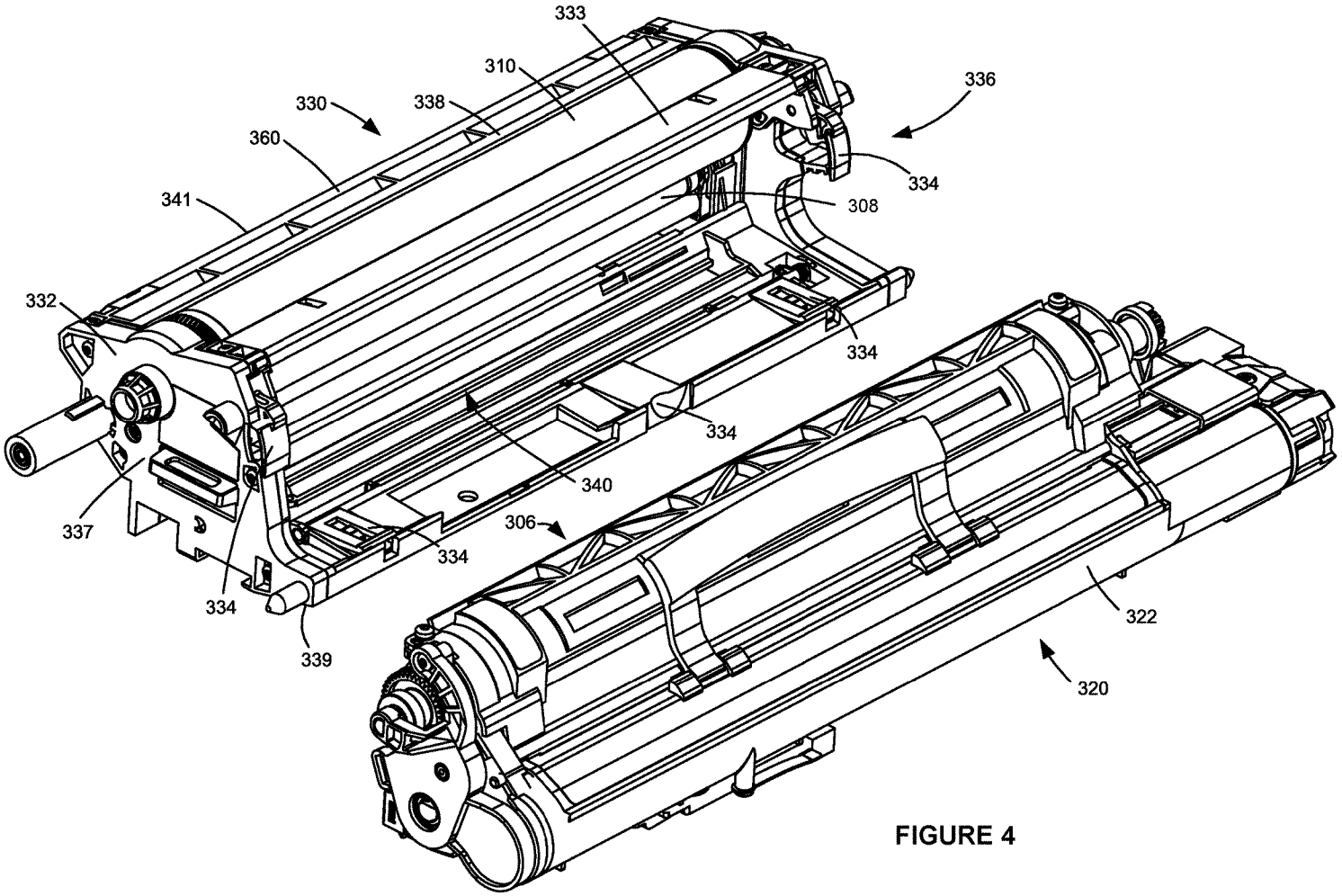
FIG. 4 is a perspective view of the imaging unit showing the developer unit separated from the photoconductor unit according to one example embodiment.

FIGS. 3 and 4 show imaging unit 300 according to one example embodiment. Imaging unit 300 includes a developer unit 320 and a photoconductor unit (PC unit) 330. In the example embodiment illustrated, developer unit 320 is removably coupled to PC unit 330 to permit repair or replacement of developer unit 320 independent of PC unit 330 and vice versa. In other embodiments, developer unit 320 and PC unit 330 are fixed together such that imaging unit 300 is replaced as a single unit. PC unit 330 includes a housing 332 having PC drum 310 as well as charge roll 308 and a cleaner blade/roll (not shown) mounted thereto. Housing 332 may also include one or more user-actuated latches 334 that couple developer unit 320 to PC unit 330 as shown in FIG. 3 for operation in image forming device 100 and that permit a user to separate developer unit 320 from PC unit 330 when imaging unit 300 is removed from image forming device 100 as shown in FIG. 4. Developer unit 320 includes a housing 322 having reservoir 302 therein. Housing 322 extends generally along an axial dimension of magnetic roll 306, which is substantially parallel to an axial dimension of PC drum 310. A portion of magnetic roll 306 is exposed from reservoir 302 at one side of housing 322 for mating with PC drum 310 when developer unit 320 is coupled to PC unit 330. When developer unit 320 is coupled to PC unit 330, imaging unit 300 is insertable into image forming device 100 via a sliding motion along an insertion direction 326 as indicated in FIG. 3.

With reference to FIG. 4, housing 332 includes a front end 336 that leads during insertion of PC unit 330 into image forming device 100 and a rear end 337 opposite front end 336 that trails during insertion of PC unit 330 into image forming device 100. In the embodiment illustrated, the axis of PC drum 310 extends along a front-to-rear dimension of housing 332 (i.e., along a horizontal dimension of housing 332 extending from front end 336 to rear end 337). Housing 332 also includes a top 338, a bottom 339 and a pair of sides 340, 341. In the embodiment illustrated, a portion of PC drum 310 is exposed at top 338 of housing 332 where PC drum 310 transfers the toner image formed on the surface of PC drum 310 to ITM 190 or to the print media. A portion of PC drum 310 is also exposed on side 340 of housing 332 facing magnetic roll 306 where toner is transferred to the surface of PC drum 310 by magnetic roll 306 when developer unit 320 is mated with PC unit 330.

Figure 5:
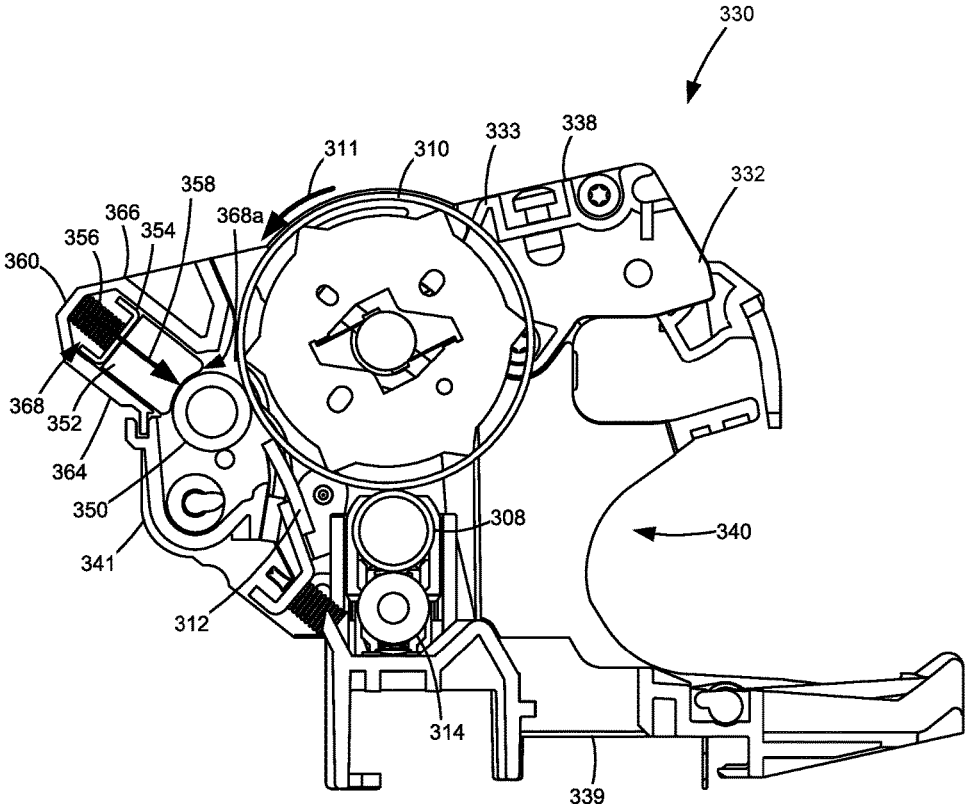
FIG. 5 is a cross-sectional view of the photoconductor unit according to one example embodiment.

FIG. 5 is a cross-sectional view of PC unit 330 according to one example embodiment. The operative rotational direction of PC drum 310 is indicated by the arrow 311 in FIG. 5. FIG. 5 shows charge roll 308 in contact with the surface of PC drum 310 to charge the surface of PC drum 310 and a cleaner blade 312 in contact with the surface of PC drum 310 to remove toner remnants from the surface of PC drum 310 prior to charging. A charge roll cleaner roll 314 may be provided in contact with the outer surface of charge roll 308 in order to remove toner particles and other contaminants from the outer surface of charge roll 308.

PC unit 330 also includes a rotatable applicator brush 350 that extends along the axial length of PC drum 310 and applies a lubricant, e.g., zinc stearate, from a lubricant supply to the surface of PC drum 310 during operation to ensure that the surface of PC drum 310 remains properly lubricated. If the surface of PC drum 310 is not properly lubricated, excessive friction may occur between the surface of PC drum 310 and cleaner blade 312 resulting in damage to the surface of PC drum 310 or the displacement of cleaner blade 312 from its working position shown in FIG. 5. In the embodiment illustrated, the lubricant supply includes a lubricant block 352 that is positioned against and extends along the length of applicator brush 350 and that resupplies lubricant to applicator brush 350 over the life of PC unit 330. Lubricant block 352 may include a solid bar or other desired shape composed of lubricant material, similar to a bar of soap. In the embodiment illustrated, lubricant block 352 is mounted, e.g., by adhesive, to a bracket 354 that supports and locates lubricant block 352. Bracket 354 is movable within housing 332 toward and away from applicator brush 350. One or more biasing members, e.g., compression springs 356, bias bracket 354 and lubricant block 352 toward applicator brush 350, in the direction indicated by arrow 358 in FIG. 5. The bias on bracket 354 and lubricant block 352 presses lubricant block 352 against applicator brush 350 to ensure that lubricant block 352 continues to supply lubricant to applicator brush 350 as lubricant block 352 is gradually depleted over the life of PC unit 330. In some embodiments, bracket 354 is weighted in order to supplement the bias force on bracket 354 and to dampen vibrations.

In the embodiment illustrated, lubricant block 352 is retained in a removable cap 360 that permits replacement or resupply of lubricant block 352 independent of the other components of PC unit 330. Cap 360 is removably mounted, e.g., by fasteners 362 accessible on the exterior of PC unit 330, to a main body 333 of housing 332 (see also FIGS. 3 and 4). In the embodiment illustrated, cap 360 extends in the longitudinal dimension of PC unit 330 (i.e., in the axial dimension of PC drum 310) along the top 338 of housing 332 at side 341. In this embodiment, cap 360 includes a side portion 364 and a top portion 366. Lubricant block 352, bracket 354 and springs 356 are positioned within a cavity 368 formed within cap 360. An inner side 368*a* of cavity 368 extending longitudinally along cap 360 is open allowing lubricant block 352 to contact applicator brush 350.

Figure 6:
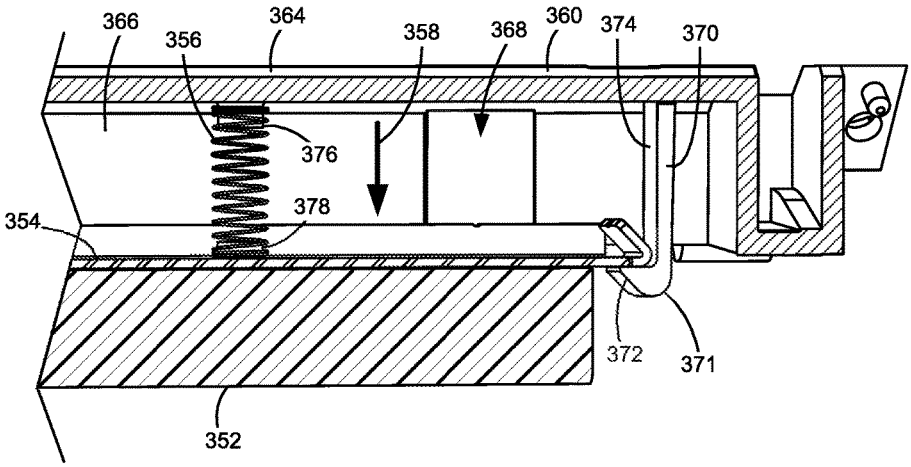
FIG. 6 is a cross-sectional view of a cap of the photoconductor unit that retains a lubricant bar according to one example embodiment.
Figure 7:
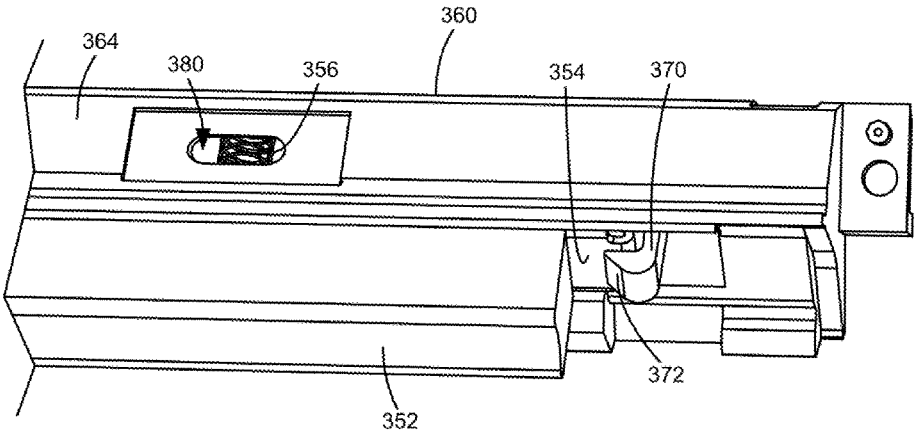
FIG. 7 is a perspective view of the cap shown in FIG. 6.

FIGS. 6 and 7 show the positioning of lubricant block 352, bracket 354 and springs 356 within cavity 368 of cap 360 in greater detail. As shown in FIG. 6, each spring 356 is compressed between a surface of bracket 354 opposite lubricant block 352 and an inner surface of cap 360. The ends of spring 356 may be retained by corresponding bosses 376, 378 to prevent spring 356 from displacing. Cap 360 includes a retainer such as a retention tab 370 at each longitudinal end thereof. In the example embodiment illustrated, each retention tab 370 extends in a cantilevered manner from an inner surface of cap 360 in the direction of bias 358 of lubricant block 352 toward applicator brush 350. A hook or catch 372 is formed at a free end 371 of each retention tab 370. In the example embodiment illustrated, catches 372 extend inward, toward each other along the longitudinal dimension of cap 360. An inboard side 374 of each retention tab 370 limits the longitudinal motion of bracket 354 thereby limiting the longitudinal motion of lubricant block 352 relative to applicator brush 350 (along the axial dimension of applicator brush 350). Limiting the longitudinal motion of bracket 354 relative to cap 360 also helps maintain alignment between bosses 378 on bracket 354 and bosses 376 on cap 360 in order to prevent buckling of springs 356.

Figure 8:
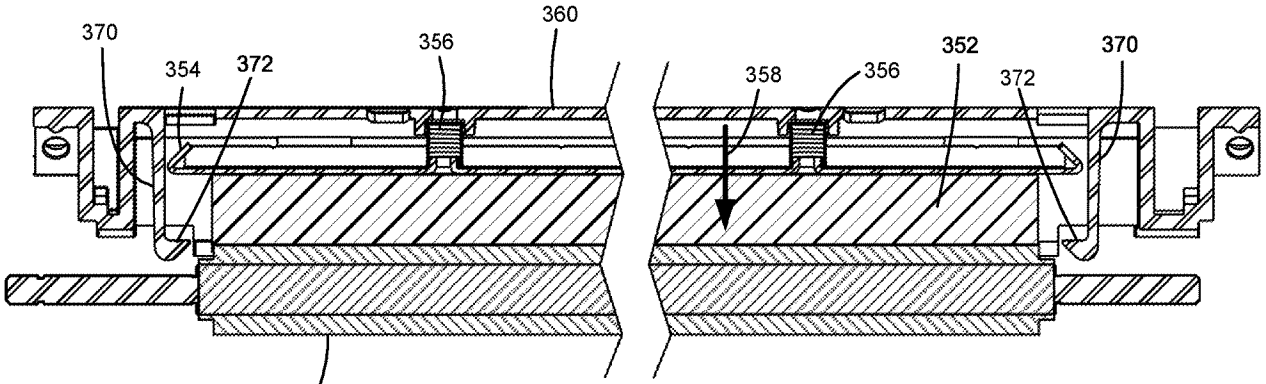
FIG. 8 is a cross-sectional view of the cap shown in FIGS. 6 and 7 showing the lubricant bar in contact with a lubricant applicator brush prior to depletion of the lubricant bar according to one example embodiment.
Figure 9:
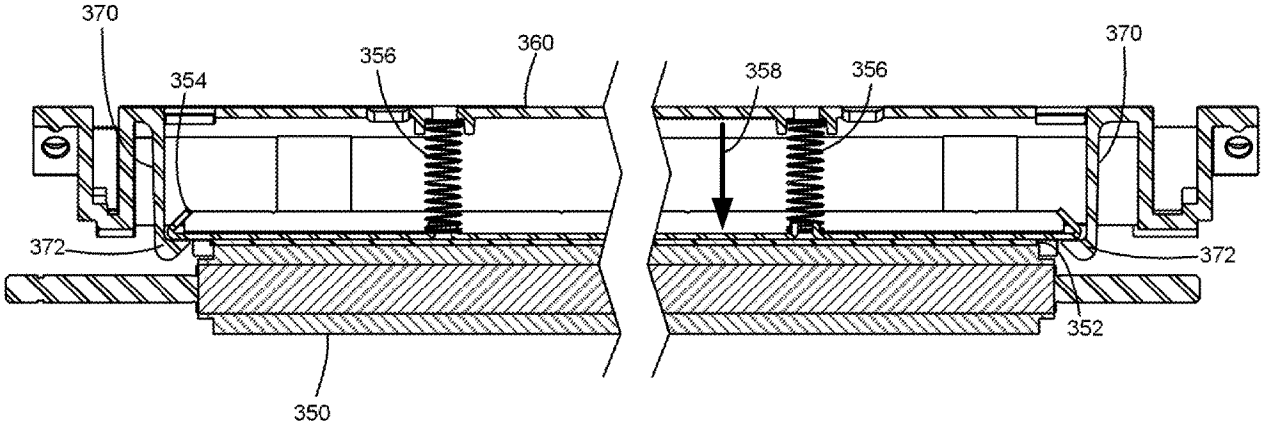
FIG. 9 is a cross-sectional view of the cap shown in FIGS. 6-8 when the lubricant bar is fully depleted according to one example embodiment.

With reference to FIGS. 8 and 9, catches 372 also limit the travel of bracket 354 and lubricant block 352 in the direction of bias 358 of lubricant block 352 toward applicator brush 350. FIGS. 8 and 9 show lubricant block 352 positioned against applicator brush 350. FIG. 8 shows lubricant block 352 prior to depletion and FIG. 9 shows lubricant block 352 fully depleted. As lubricant material is applied by applicator brush 350 to PC drum 310 during operation thereby depleting lubricant block 352, lubricant block 352 and bracket 354 gradually move toward applicator brush 350 as a result of the bias applied by springs 356. Catches 372 are positioned to contact bracket 354 and stop the advance of lubricant block 352 toward applicator brush 350 before bracket 354 or any adhesive material on bracket 354 reaches the bristles of applicator brush 350 in order to avoid damaging or contaminating applicator brush 350.

In addition to permitting replacement of lubricant block 352 independent of the other components of PC unit 330, cap 360 also provides for ease of assembly of lubricant block 352 with bracket 354 and springs 356. In one embodiment, springs 356 are first inserted into cavity 368 in cap 360. One end of each spring 356 is mated with its corresponding boss 376 on the inner surface of cap 360. Bracket 354 having lubricant block 352 attached thereto is then pressed into cavity 368 of cap 360 with the bosses 378 on the surface of bracket 354 opposite lubricant block 352 aligned with springs 356. As shown in FIG. 7, side portion 364 of cap 360 may include an opening or window 380 at the location of each spring 356 that allows for visual confirmation that each spring 356 is correctly positioned during assembly. Windows 380 may then be covered with a filter and serve as an air vent for PC unit 330 during operation. As bracket 354 is pushed against the bias of spring 356 toward cavity 368, the longitudinal ends of bracket 354 contact catches 372 causing retention tabs 370 to deflect outward away from each other allowing bracket 354 to enter cavity 360. After the longitudinal ends of bracket 354 pass catches 372, retention tabs 370 return to their original positions shown in FIGS. 8 and 9. In this manner, bracket 354 can be said to snap into position within cavity 368 of cap 360. Bracket 354 is longer than lubricant block 352 allowing lubricant block 352 to extend past catches 372 in the direction of bias 358 while catches 372 prevent bracket 354 from escaping cavity 368. In this manner, catches 372 retain bracket 354 and lubricant block 352 in cavity 368 preventing bracket 354 and lubricant block 352 from falling out of cavity 368 during handling of cap 360. Cap 360 is then aligned and fastened onto main body 333 of housing 332 with lubricant block 352 positioned against applicator brush 350.

Further, because cap 360 is separable from main body 333 of housing 332, changes to lubricant block 352 can be made with relative ease. For example, if a lubricant block 352 of a different size, angle, material, etc. is desired, the existing cap 360 can simply be replaced with a new cap 360 having a lubricant block 352 of the desired characteristics.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A photoconductor lubricant assembly, comprising:

a cap that is detachably mountable onto a housing of a photoconductor unit;

a lubricant supply mounted on the cap for providing a lubricant material to a photoconductive drum of the photoconductor unit, the lubricant supply includes a block composed of the lubricant material;

a retention tab on the cap that retains the lubricant supply on the cap, the retention tab is deflectable providing a snap-fit engagement of the lubricant supply onto the cap; and a biasing member biasing the lubricant supply against the retention tab.

2. The photoconductor lubricant assembly of claim 1, wherein the lubricant supply includes a bracket that is movable relative to the cap, the block composed of the lubricant material is attached to the bracket.

3. The photoconductor lubricant assembly of claim 1, wherein the retention tab limits travel of the block composed of the lubricant material relative to the cap in a direction of bias of the biasing member on the lubricant supply.

4. The photoconductor lubricant assembly of claim 3, wherein the retention tab limits travel of the block composed of the lubricant material relative to the cap along a longitudinal dimension of the block composed of the lubricant material.

5. A photoconductor unit for an electrophotographic image forming device, comprising:

a housing;

a photoconductive drum rotatably mounted on the housing, the photoconductive drum having an outer surface;

a lubricant applicator brush rotatably mounted on the housing and in contact with the outer surface of the photoconductive drum along a length of the outer surface of the photoconductive drum;

a cap detachably mounted on the housing;

a lubricant supply mounted on the cap, the lubricant supply includes a block composed of a lubricant material;

a retainer on the cap that retains the lubricant supply on the cap when the cap is detached from the housing, the retainer is deflectable providing a snap-fit engagement of the lubricant supply onto the cap; and a biasing member biasing the block composed of the lubricant material against the lubricant applicator brush.

6. The photoconductor unit of claim 5, wherein the lubricant supply includes a bracket that is movable relative to the cap toward and away from the lubricant applicator brush, the block composed of the lubricant material is attached to the bracket.

7. The photoconductor unit of claim 5, wherein the retainer limits travel of the block composed of the lubricant material relative to the cap in a direction toward the lubricant applicator brush.

8. The photoconductor unit of claim 7, wherein the retainer limits travel of the block composed of the lubricant material relative to the cap along an axial dimension of the lubricant applicator brush.

9. A photoconductor unit for an electrophotographic image forming device, comprising:

a housing;

a photoconductive drum rotatably mounted on the housing, the photoconductive drum having an outer surface;

a cap detachably mounted on the housing;

a lubricant supply mounted on the cap positioned to provide a lubricant material to the outer surface of the photoconductive drum; and a retainer on the cap that retains the lubricant supply on the cap when the cap is detached from the housing, the retainer is deflectable providing a snap-fit engagement of the lubricant supply onto the cap.

* * * * *